US011110338B1

(12) United States Patent
Miller

(10) Patent No.: US 11,110,338 B1
(45) Date of Patent: Sep. 7, 2021

(54) SKI BINDING WITH HEELLESS TELEMARK COUPLING

(71) Applicant: Thomas Alan Miller, Durango, CO (US)

(72) Inventor: Thomas Alan Miller, Durango, CO (US)

( * ) Notice: Subject to any disclaimer, the term of this patent is extended or adjusted under 35 U.S.C. 154(b) by 0 days.

(21) Appl. No.: 16/928,961

(22) Filed: Jul. 14, 2020

(51) Int. Cl.
*A63C 9/06* (2012.01)
*A63C 9/24* (2012.01)
*A63C 9/00* (2012.01)

(52) U.S. Cl.
CPC ..... *A63C 9/06* (2013.01); *A63C 9/006* (2013.01); *A63C 9/245* (2013.01)

(58) Field of Classification Search
CPC ..... A63C 9/02; A63C 9/006
USPC ..... 280/614, 615
See application file for complete search history.

(56) References Cited

U.S. PATENT DOCUMENTS 4,116,463 A * 9/1978 Zoor ..... A63C 9/20 280/605
4,166,634 A * 9/1979 Kirchmeyr ..... A63C 9/086 280/614
4,227,715 A * 10/1980 Kirchmeyr ..... A63C 9/0807 280/614
4,322,090 A * 3/1982 Loughney ..... A63C 9/0807 280/614
4,533,154 A * 8/1985 Bernard ..... A63C 9/18 280/615
4,553,771 A * 11/1985 Bernard ..... A63C 9/20 280/615
4,682,785 A * 7/1987 Jungkind ..... A63C 9/20 280/615
4,722,613 A * 2/1988 Jungkind ..... A63C 9/20 280/615
4,887,833 A * 12/1989 Bailey ..... A43B 5/0496 280/615
5,190,309 A * 3/1993 Spitaler ..... A63C 9/20 280/615
5,318,320 A * 6/1994 Ramer ..... A63C 9/006 280/614
5,338,053 A * 8/1994 Hauglin ..... A63C 9/20 280/615

(Continued)

FOREIGN PATENT DOCUMENTS

EP 3096845 B1 1/2016

*Primary Examiner* — Jeffrey J Restifo

(57) ABSTRACT

Presented is one embodiment of a telemark-capable ski binding system which combines the conventional tech style toe piece or front coupling with a telemark tension assembly (110) that provides the necessary rotational resistance to a ski boot (300) but still allows the ski boot heel to be raised for a telemark style turn upon descent. Telemark tension assembly (110) can be adjusted to alter the engagement of telemark tension assembly (110) according to user preference and conditions for descent. Telemark tension assembly (110) can also be loosened to the point that adjustable restraint (112) can be rotated forward and rest unengaged in front of ski boot (300) for free rotation in toe coupling (100) during ascent or touring. This embodiment provides a lightweight telemark ski binding system that has improved resistance to undesirable snow gathering. Other embodiments are described that have adjustability features and alpine descent mode.

19 Claims, 8 Drawing Sheets

(56) References Cited

U.S. PATENT DOCUMENTS 5,499,838 A * 3/1996 Hauglin ..... A63C 9/06 280/615
5,669,622 A * 9/1997 Miller ..... A63C 9/02 280/615
5,803,480 A * 9/1998 Hauglin ..... A63C 9/02 280/615
5,897,127 A * 4/1999 Hauglin ..... A63C 9/06 280/615
5,924,719 A * 7/1999 Girard ..... A63C 9/20 280/615
5,944,337 A * 8/1999 Girard ..... A63C 9/20 280/615
5,947,507 A * 9/1999 Quintana ..... A63C 9/20 280/615
6,017,050 A * 1/2000 Girard ..... A43B 5/0413 280/615
6,234,514 B1 * 5/2001 Dubuque ..... A63C 9/083 280/615
6,390,494 B2 * 5/2002 Gignoux ..... A63C 9/20 280/615
6,402,184 B1 * 6/2002 Hauglin ..... A63C 9/20 280/615
6,431,578 B2 * 8/2002 Pedersen ..... A63C 9/006 280/626
6,685,213 B2 * 2/2004 Hauglin ..... A63C 9/00 280/615
6,923,465 B2 * 8/2005 DuBuque ..... A63C 9/00 280/607
6,986,526 B2 * 1/2006 Haughlin ..... A63C 9/20 280/613
7,207,591 B2 * 4/2007 Riedel ..... A63C 9/02 280/611
7,216,888 B1 * 5/2007 Walker ..... A63C 9/02 280/614
7,216,890 B2 * 5/2007 Walker ..... A63C 9/02 280/612
7,219,917 B2 * 5/2007 Walker ..... A63C 9/245 280/611
7,246,812 B1 * 7/2007 Ayliffe ..... A63C 9/20 280/615
7,306,255 B2 * 12/2007 Walker ..... A63C 9/02 280/614
7,306,256 B2 * 12/2007 Walker ..... A63C 9/02 280/614
7,318,597 B2 * 1/2008 Walker ..... A63C 9/02 280/614
7,384,057 B2 * 6/2008 Steffen ..... A63C 9/245 280/611
7,568,719 B2 * 8/2009 Sauter ..... A63C 10/04 280/619
7,681,905 B2 * 3/2010 Hauglin ..... A63C 9/0807 280/615
7,922,188 B2 * 4/2011 Kogler ..... A63C 9/20 280/615
8,167,331 B2 * 5/2012 Wollo ..... A63C 9/02 280/621
8,191,918 B2 * 6/2012 Pupko ..... A63C 9/005 280/618
8,328,225 B2 * 12/2012 Prigge ..... A63C 9/02 280/614
8,534,697 B2 * 9/2013 Lengel ..... A63C 9/086 280/617
8,763,209 B2 * 7/2014 Kavarsky ..... A43C 11/142 24/68 SK
8,763,210 B2 * 7/2014 Vincent ..... A43C 11/146 24/68 SK
8,827,302 B2 * 9/2014 Fritschi ..... A63C 9/0807 280/623
8,925,956 B1 * 1/2015 Harkin ..... A63C 13/003 280/604
9,126,099 B2 * 9/2015 Ritter ..... A63C 10/20
9,233,295 B2 * 1/2016 Indulti ..... A63C 9/086
9,452,343 B2 * 9/2016 Schroer ..... A43B 5/0496
9,545,560 B2 * 1/2017 Chen ..... A63C 10/06
9,827,481 B2 * 11/2017 Ritter ..... A63C 9/02
10,016,672 B2 * 7/2018 Mouyade ..... A63C 9/08592
10,035,058 B1 * 7/2018 Ritter ..... A63C 10/14
10,058,763 B2 * 8/2018 Bombard ..... A63C 9/20
10,537,150 B2 * 1/2020 Bruel ..... A43B 5/0452
10,946,265 B2 * 3/2021 Zoor ..... A63C 9/0846
2003/0155742 A1 * 8/2003 Riedel ..... A63C 9/08578 280/615
2004/0164519 A1 * 8/2004 Quellais ..... A63C 17/065 280/615
2004/0262886 A1 * 12/2004 Girard ..... A43B 5/0496 280/615

* cited by examiner

SKI BINDING WITH HEELLESS TELEMARK COUPLING

BACKGROUND

Prior Art

The table below is a tabulation of relevant prior art:

| US Patents | | | |
|---|---|---|---|
| Patent Number | Kind Code | Issue | Date Patantee |
| 5499838 | A | 1996 Mar. 19 | Hauglin |
| 7216888 | B1 | 2007 May 15 | Walker |
| 8534697 | B2 | 2013 Sep. 07 | Lengel |
| 9233295 | B2 | 2016 Jan. 12 | Indulti |

| Foreign Patent Documents | | | | |
|---|---|---|---|---|
| Document No. | Country Code | Kind Code | Pub. Date | App or Patentee |
| 3096845 | EP | B1 | 2016 Jan. 26 | Mouyade |

Telemark-capable ski bindings historically employed a means to retain the toe of a ski boot with a "duckbill". The "duckbill" is a portion of boot sole jutting out from the front of the boot that is inserted into the toe piece of the binding meant to retain the boot laterally and in a forward direction longitudinally. A means to retain the boot in the rearward longitudinal direction was typically in the form of a heel clamp and a cable or rod assembly in combination with some form of compression or extension spring. An example of this is the ski binding in U.S. Pat. No. 5,499,838A Hauglin, 1996 Mar. 19. This arrangement binds the boot to the ski laterally and longitudinally but allows the heel of the boot to rotate upward off of the ski facilitating the telemark style turn and touring capability. The toe box portion of the boot is semi-rigidly held. While the "duckbill" is held firmly, the rear of the toe box is allowed some upward movement through a bellows in the toe box and a flexible soled boot. The heel retention hardware cannot be released or removed for ascent since it is needed to bind the boot in the rearward longitudinal direction.

When alpine touring bindings became popular it was clear that this type of telemark binding was not as efficient in climbing or touring mode due to the resistance of the heel retention system as well as the resistance to flex the sole of the boot at the toe box since it is rigidly held at the "duckbill". Many bindings are available that attempt to address this problem. Some of these keep the same retention system and but simply add a means for the "duckbill" cage to rotate freely when touring and be held down when descending. An example of this is U.S. Pat. No. 7,216,888B1 Walker, 2007 May 15. This adds considerable complexity and weight to the binding. In my experience these arrangements are prone to having snow build up and pack in under the rotating binding while climbing, especially in wet snow conditions. The mechanisms for switching from ascent to descent modes are also prone to icing making them difficult to manage in certain conditions. Another approach has been to take advantage of the benefits of alpine touring technology. A combination of an alpine touring toe piece of the type commonly known as a tech binding with a traditional rod and compression spring rear or heel retention system in U.S. Pat. No. 8,354,697B2 Lengel, 2013 Sep. 17, is an example of this. While this approach is straight forward, I have found that the heel retention hardware which rests on the ski during ascent, collects snow to an extreme degree while climbing in deep and sticky snow conditions. While the heel retention hardware can be removed to alleviate this, that adds removing and replacing the heel retention hardware on every ascent to descent change. I have also found that this setup has a different telemark turn dynamic than traditional telemark bindings. This is due to the immediate engagement of the heel retention hardware upon raising the heel. Another example is a tech binding toe piece combined with a boot sole coupling for retention and telemark turn tension as in patent EP3096845B1 Mouyade, 2016 Jan. 26. This also adds complexity, snow packing issues, and a different telemark turn dynamic in addition to requiring the boot to have a special sole to cooperate with the retention and tensioning system. Another attempt to make a tech style toe piece work in combination with an additional coupling device can be seen in U.S. Pat. No. 9,233,925B2 Indulti, 2016 Jan. 12. Here a sole retaining device is added to the tech toe coupling to simulate the boot sole retention characteristics of a traditional telemark binding for descent. This arrangement restricts the range of motion of the heel portion of boot and also results in different telemark turn dynamic in comparison to traditional telemark bindings.

SUMMARY

One embodiment of my ski binding system combines the conventional tech alpine touring toe piece with an over the toe box adjustable restraint and a rotational tensioner that provides the necessary rotational resistance for a telemark turn. The adjustable restraint can be loosened or released for ascent when the rotational tension is not needed. Prior to descent the heelless toe box coupling can be tightened to provide the needed tension to execute telemark style turns. The design and shape of the presented embodiment reduces snow compaction problems under the ski boot. Other embodiments are described that have alternate designs for adjustability and alpine turn capability for descent.

Advantages

Several advantages of one or more aspects are as follows: a lightweight telemark ski binding system that has no heel coupling that can collect snow while climbing, that has no heel coupling that has to be removed to prevent snow collecting while climbing, has a coupling in the front to eliminate having to reach behind the boot to release, provides a skiing dynamic or feel that is more like traditional telemark bindings, that does not require any specific heel or sole type of the ski boot, and can rotate freely without tension while ascending. Other advantages of one or more aspects will become apparent upon examination of detailed description and drawings.

DRAWINGS—FIGURES

Figure 1:
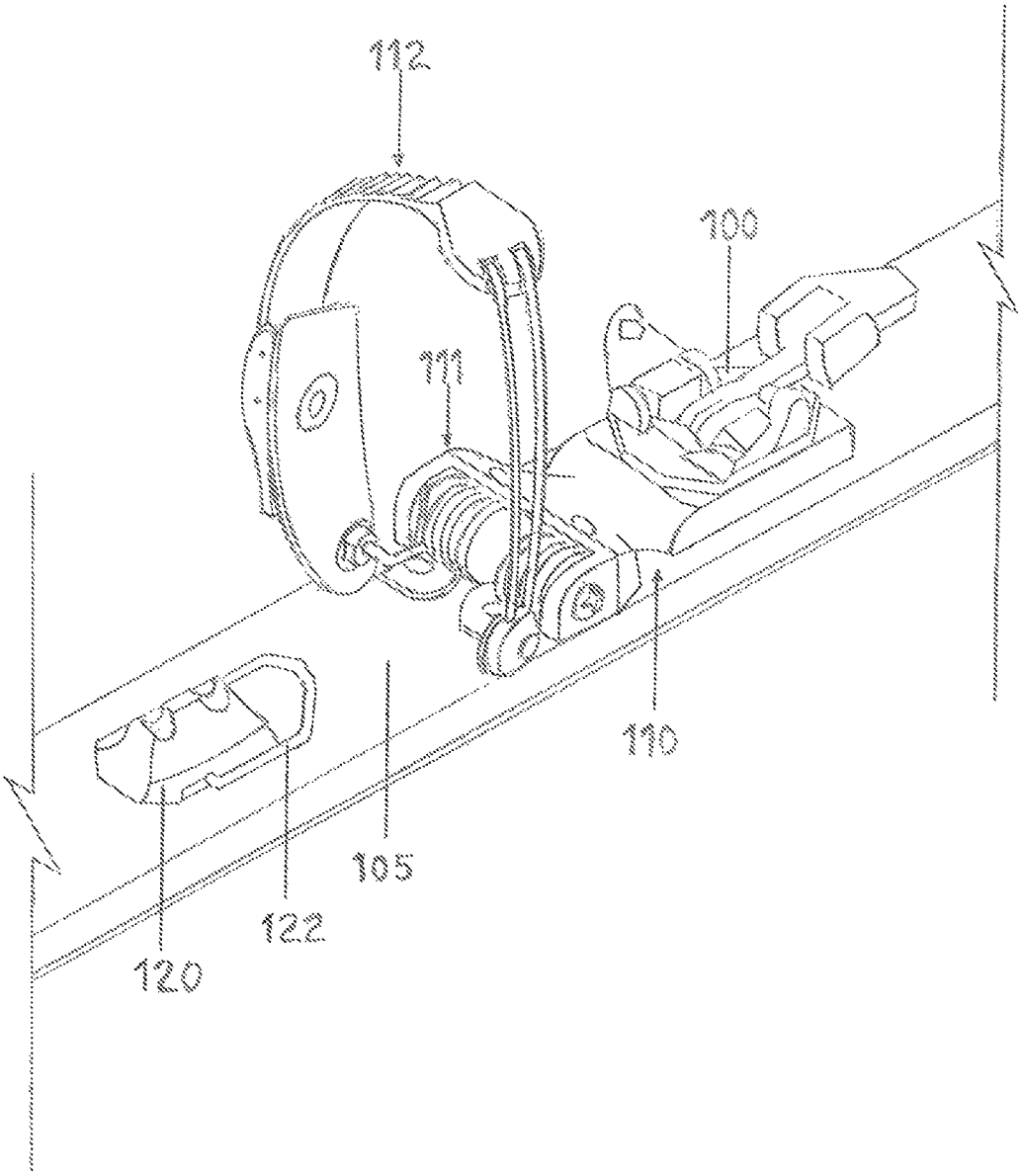
FIG. 1 is a perspective view of one embodiment.

| Drawings- Reference Numerals | |
|---|---|
| 100 toe coupling | 105 ski |
| 110 telemark tension assembly | 111 rotational tensioner |
| 112 adjustable restraint | 120 elevator block |
| 122 climbing wire | 200 spring mount |
| 201 outer mount holes | 202 mandrel bolt |
| 203 inner mount holes | 204 outside mount bracket |
| 206 outside spring | 208 mandrel |
| 209 spring spacer | 210 inside spring |
| 212 inner mount bracket | 214 mandrel nut |
| 216 strap washer | 218 wire rope loop |
| 220 ladder strap | 222 outside strap nut |
| 223 outside strap washer | 224 strap bushing |
| 226 inside strap nut | 227 inside strap washer |
| 228 ladder strap buckle | 229 buckle extension |
| 230 outside buckle nut | 231 outside buckle washer |
| 232 buckle bushing | 233 buckle extension mount hole |
| 234 inside buckle nut | 235 inside buckle washer |
| 300 ski boot | 302 ski boot bellows |
| 700 heel coupling | 702 toe shim |
| 703 boot shim | 711 adjustable tensioner |
| 720 heel shim | 801 shim mount holes |
| 803 toe coupling mount holes | 804 modified outside mount bracket |
| 805 bracket mount holes | 812 modified inside mount bracket |

DETAILED DESCRIPTION OF FIRST EMBODIMENT FIGS. 1-2

One embodiment of my ski binding system is shown in FIG. 1. A toe coupling 100 is mounted to a telemark tension assembly 110 which is mounted to a ski 105. The toe coupling shown is of the conventional tech type wherein the coupling clamps to a boot with pins designed to engage sockets on the toe portion of the boot. Telemark tension assembly 110 is a combination of an adjustable restraint 112 joined to a rotational tensioner 111. An elevator block 120 is mounted to ski 105 behind telemark tension assembly 110. Elevator block 120 holds a rotatable climbing wire 122 in place.

Figure 2:
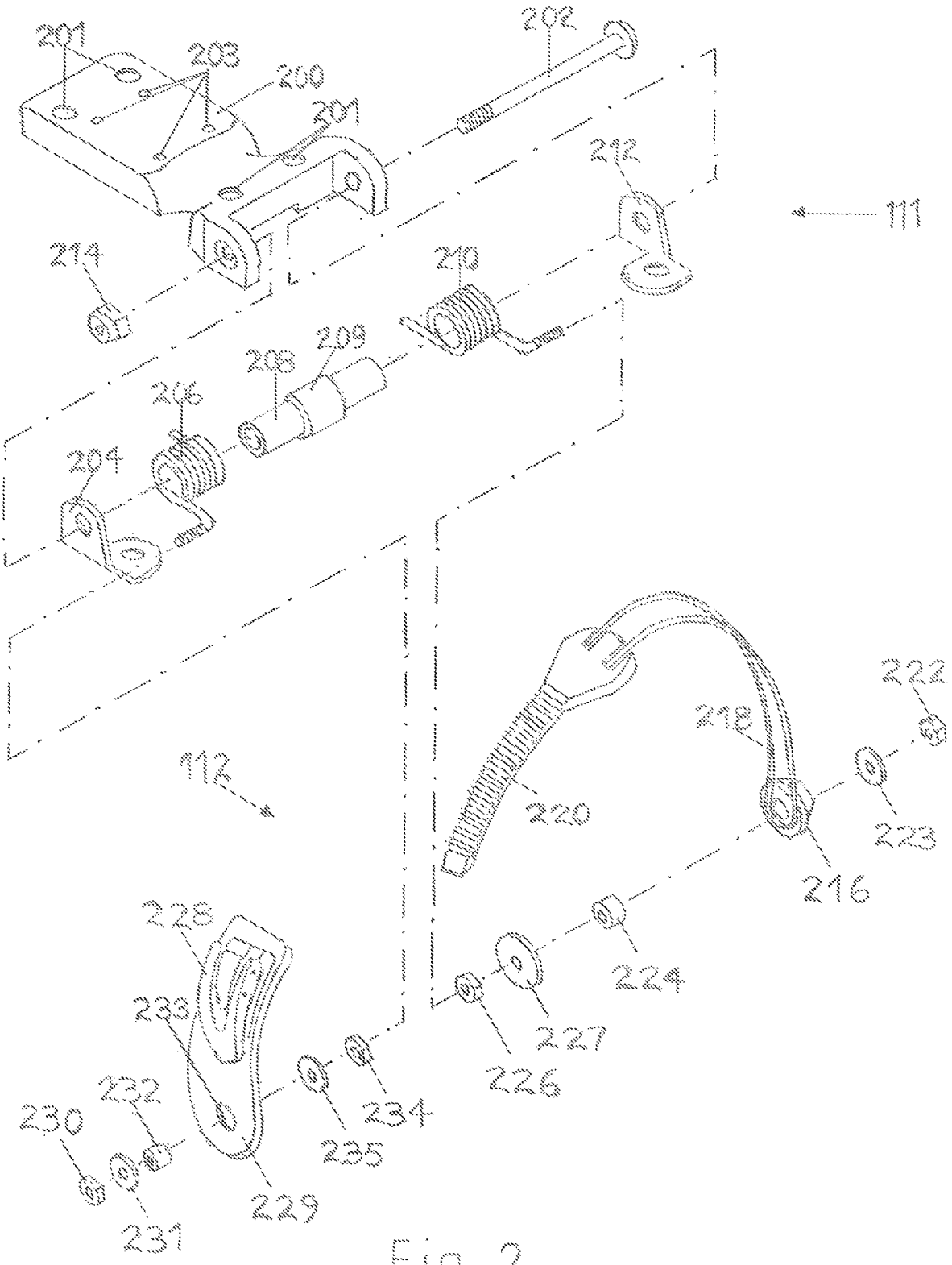
FIG. 2 is an exploded perspective view of one embodiment of the heelless telemark coupling or telemark tension assembly.

FIG. 2 is an exploded view of telemark tension assembly 110. A spring mount 200 is mounted to ski 105 through a set of outer mount holes 201. Toe coupling 100 is mounted to the spring mount 200 through a set of inner mount holes 203 which can be threaded to accept screws. Spring mount 200 can be made from rigid, impact resistant plastic such as nylon or acrylonitrile butadiene styrene. This embodiment is shown with an outside mount bracket 204 and an inside mount bracket 212 of steel, aluminum, titanium or other suitable rigid material to add support to spring mount 200. Spring mount 200 could also be made of a metal such as aluminum or other material of sufficient rigidity and strength to render outside mount bracket 204 and inside mount bracket 212 unnecessary. An outside torsion spring 206 and an inside torsion spring 210 are held in place on spring mount 200, outside mount bracket 204 and inside mount bracket 212 with a mandrel bolt 202 and a mandrel nut 214. Outside spring 206 and inside spring 210 are wound in opposite directions. Outside spring 206 and inside spring 210 otherwise have the same spring characteristics. The spring parameters such as, but not limited to, number of coils, diameter of coils and spring wire thickness, determine these characteristics. These spring parameters can be adjusted to produce sets of springs to accommodate different skier weight ranges and preferences with regards to desired tension while executing a telemark style turn. The springs may be made of typical torsion spring materials such as music wire or stainless steel among other possibilities. A mandrel 208 made of nylon, polyurethane or other suitable semi-flexible material is fitted over mandrel bolt 202 and inside the coils of outside spring 206 and inside spring 210. The inside diameter of mandrel 208 is such that it fits tightly over mandrel bolt 202. The outside diameter of mandrel 208 is sufficiently smaller than the inside diameter of outside spring 206 and inside spring 210 to accommodate outside spring 206 and inside spring 210 smaller inside diameter when they are under tension. A spring spacer 209 is placed over mandrel 208 to position outside spring 206 and inside spring 210 on the ends of mandrel 208. The inside diameter of spring spacer 209 is such that it fits tightly over mandrel 208. The outside diameter of spring spacer 209 is such that it closely matches the outside diameter of outside spring 206 and inside spring 210. The outside leg of outside spring 206 and the outside leg of inside spring 210 are threaded to accept nuts. Rotational tensioner 111 comprises spring mount 200 mandrel bolt 202, outside mount bracket 204, outside torsion spring 206, mandrel 208, spring spacer 209, inside torsion spring 210, inside mount bracket 212, and mandrel nut 214. An inside buckle nut 234, an inside buckle washer 235, a buckle bushing 232, a ladder strap buckle 228, a buckle extension 229, an outside buckle washer 231, and an outside buckle nut 230 are assembled in that order onto the outside leg of outside torsion spring 206. Outside buckle nut 230 is tightened to hold buckle bushing 232 snugly between inside buckle washer 235 and outside buckle washer 231. Buckle bushing 232 can be made of polyurethane, nylon, rubber or other suitable semi flexible material. The inside diameter of buckle bushing 232 is such that it fits tightly over the outside leg of outside torsion spring 206. The buckle extension mount hole 233 diameter is such that it fits tightly over buckle bushing 232 but it can still rotate freely. Buckle extension 229 can be made of polyurethane, nylon, rubber or other suitable semi flexible material. An inside strap nut 226, an inside strap washer 227, a strap bushing 224, a strap washer 216, an outside strap washer 223, and an outside strap nut 222 are assembled in that order onto the outside leg of inside spring 210. A wire rope loop 218 is inserted into the grove in strap washer 216. Inside strap washer 227 has the same outside diameter as strap washer 216 to hold wire rope loop 218 in the groove provided in strap washer 216. Wire rope loop 218 is built onto or swaged around a ladder strap 220. Ladder strap 220 has a closed groove to accept wire rope loop 218. Wire rope loop 218 is coated with vinyl or another suitable material. Strap washer 216 can be made of nylon, aluminum, or other light weight rigid materials. Strap bushing 224 has an inside diameter such that it fits tightly over the outside leg of inside spring 210 or alternately can be threaded to thread onto the outside leg of inside spring 210. Strap bushing 224 can be made of aluminum, steel or another rigid material. The length of strap bushing 224 is slightly greater than the width of strap washer 216 so that when outside strap nut 222 is tightened against outside strap washer 223 and strap bushing 224, strap washer 216 can rotate freely while still containing wire rope loop 218. Adjustable restraint 112 comprises ladder strap buckle 228, buckle extension 229, ladder strap 220, and wire rope loop 218.

Figure 3:
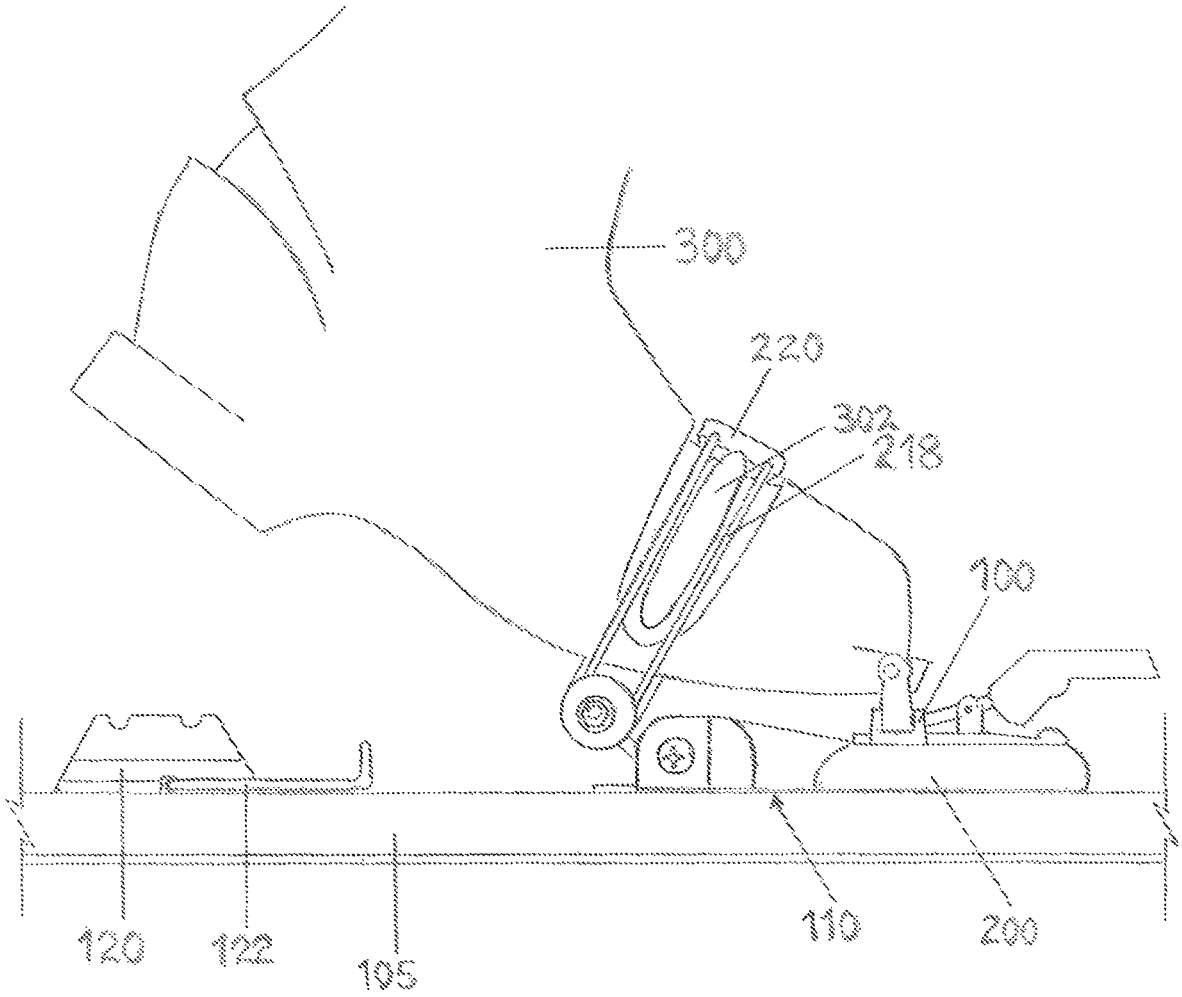
FIG. 3 is a side view of the inside side of one embodiment in descent or telemark turn mode.
Figure 4:
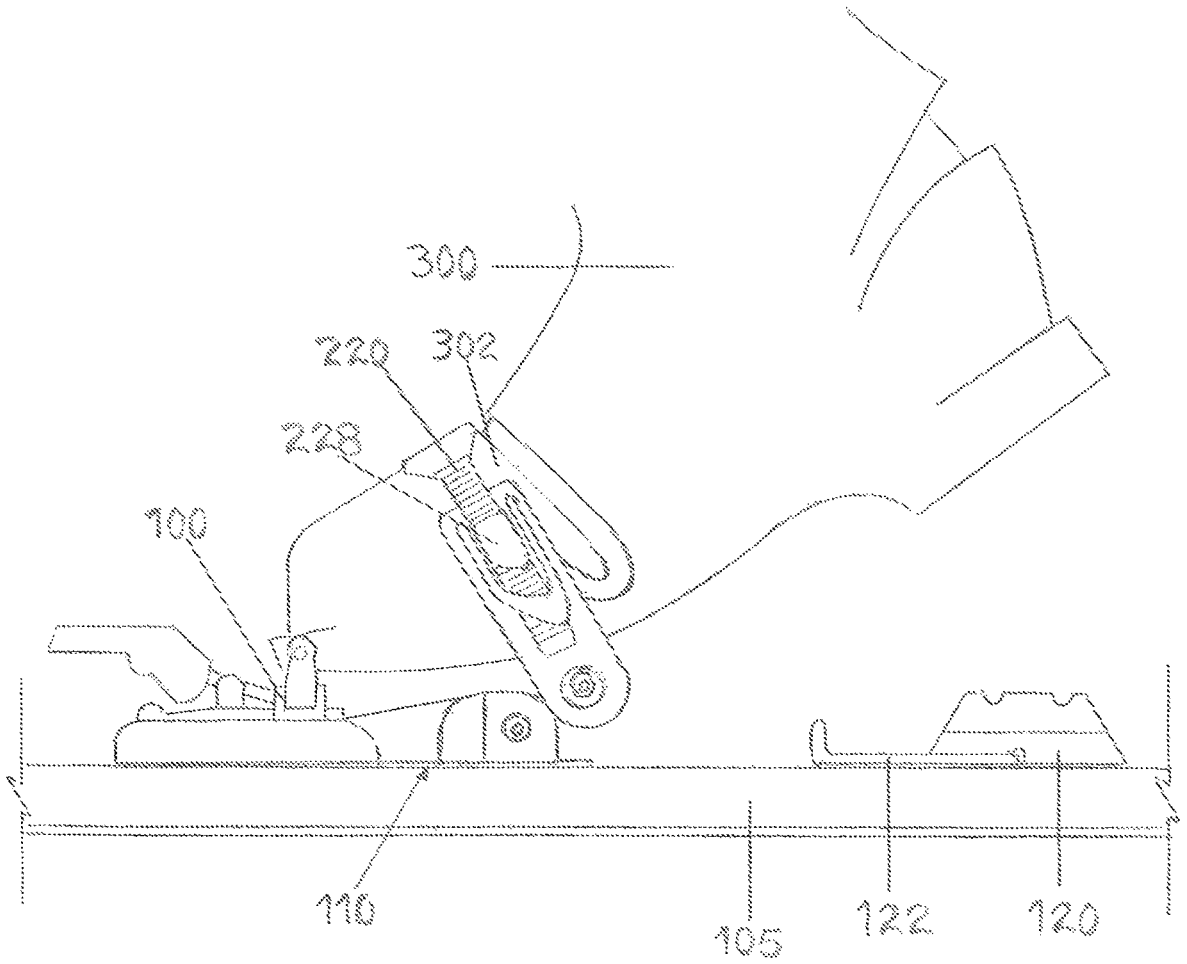
FIG. 4 is a side view of the outside side of one embodiment in descent or telemark turn mode.

Operation for Descent or Telemark Turns FIGS. 3-4

FIGS. 3 and 4 show both sides of a ski boot 300 and one embodiment of the ski binding system in descent or telemark turn configuration. A left leg or left side ski 105 and ski boot 300 are depicted here and it is noted that the right leg or right side telemark tension assembly 110 is a mirror image of the left side. Ski boot 300 is shown with a ski boot bellows 302 necessary for the skier to bend their metatarsophalangeal joints and make telemark style turns while descending. FIG. 3 is a side view of wire rope loop 218 side or ski inside side of one embodiment in descent or telemark turn mode. Toe coupling 100 is mounted to spring mount 200. Ski boot 300 is shown engaged with toe coupling 100 and telemark tension assembly 110 in descent mode. Climbing wire 122 is also in descent mode. Wire rope loop 218 is shown engaged with ski boot 300 at ski boot bellows 302. In this configuration or mode, the skier can lift the heel of ski boot 300 in a manner that facilitates a telemark style turn. Telemark tension assembly 110 is coupled tightly to ski boot 300 with wire rope loop 218 engaged in ski boot bellows 302. Telemark tension assembly 110 provides the necessary resistance for a telemark style turn while facilitating the bending of ski boot 300 at ski boot bellows 302 consistent with traditional telemark bindings.

FIG. 4 is a side view of ladder strap buckle 228 side or ski outside side of one embodiment in descent or telemark turn mode. Ski boot 300 is shown engaged with toe coupling 100 and telemark tension assembly 110 in descent mode. Ladder strap buckle 228 is closed so that wire rope loop 218 is engaged with ski boot 300 at ski boot bellows 302 on the opposite side of ski boot 300. Climbing wire 122 is also in descent mode. In this configuration or mode, as in FIG. 3, the skier can lift the heel of ski boot 300 in a manner that facilitates a telemark style turn. Telemark tension assembly 110 is coupled tightly to ski boot 300 with wire rope loop 218 engaged in ski boot bellows 302. Telemark tension assembly 110 provides the necessary resistance for a telemark style turn while facilitating the bending of ski boot 300 at ski boot bellows 302 consistent with traditional telemark bindings. Ladder strap 220 can be inserted more or less into ladder strap buckle 228 prior to closing ladder strap buckle 228 to adjust when telemark tension assembly 110 engages ski boot 300. This provides a convenient and easy way for the skier to adjust the engagement of the ski binding system for telemark turns according to skier preference and conditions.

Figure 5:
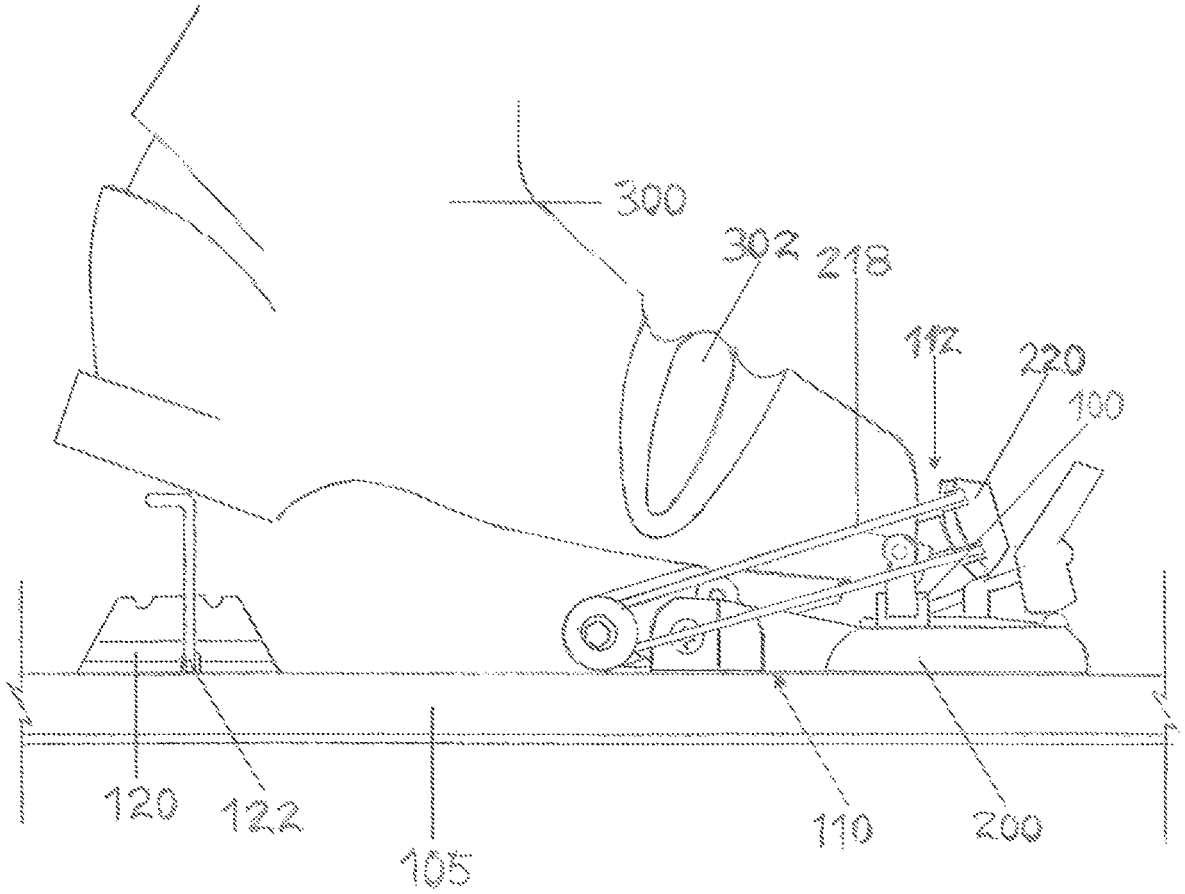
FIG. 5 is a side view of the inside side of one embodiment in ascent or climbing mode.
Figure 6:
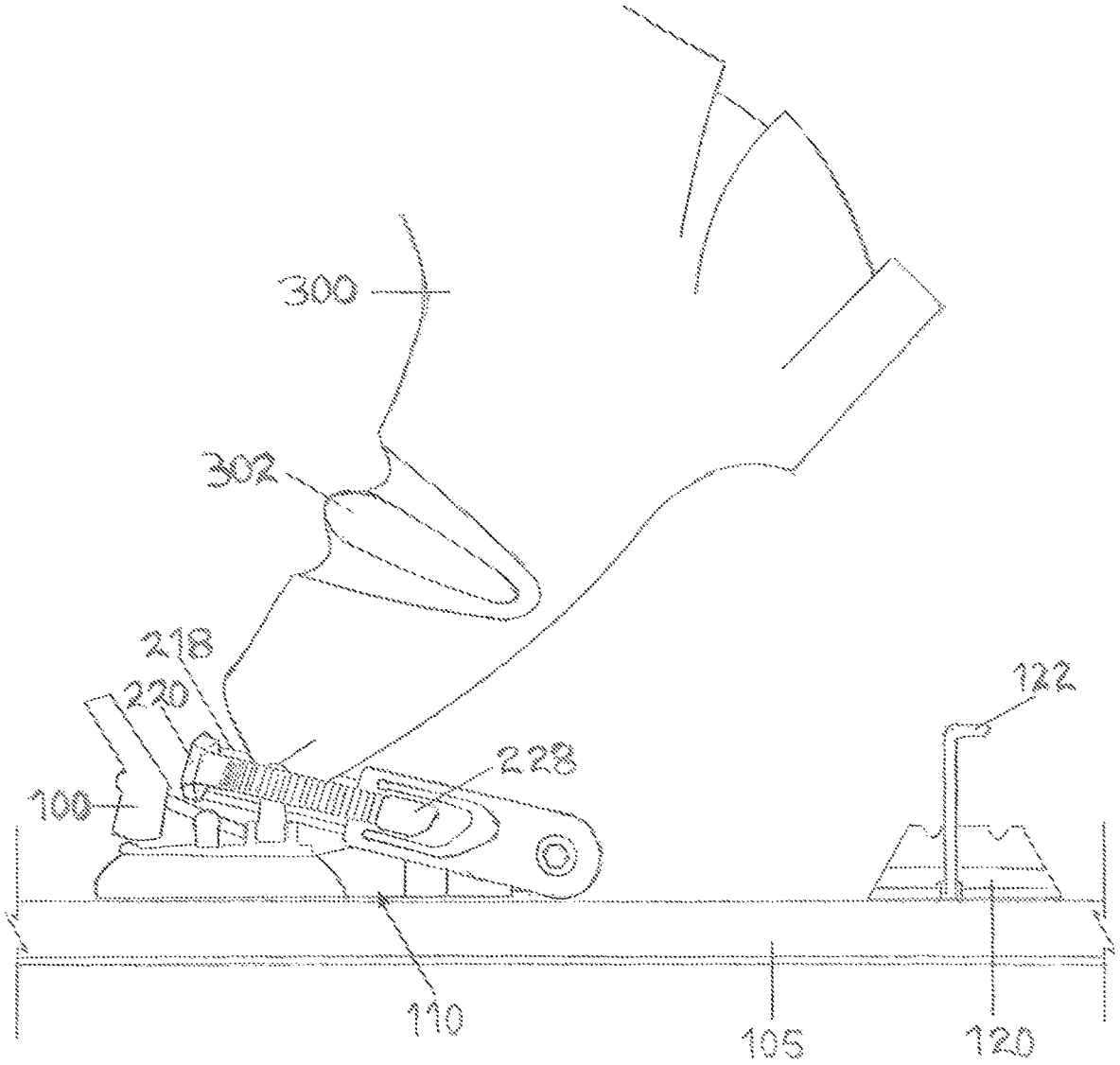
FIG. 6 is a side view of the outside side of one embodiment in ascent or climbing mode.

Operation for Ascent or Climbing FIGS. 5-6

FIGS. 5 and 6 show both sides of ski boot 300 and the ski binding system in ascent, touring or climbing configuration. FIG. 5 is a side view of wire rope loop 218 side of one embodiment in climbing configuration. Toe coupling 100 is mounted to spring mount 200. Ski boot 300 is shown engaged with toe coupling 100 and telemark tension assembly 110 in ascent mode. Climbing wire 122 is also in ascent mode. Wire rope loop 218 is shown resting inactive, loose on toe coupling 100. In this configuration the skier can freely lift the heel of ski boot 300 with no resistance from telemark tension assembly 110. This facilitates walking or striding for touring or climbing. Wire rope loop 218, ladder strap 220 and ladder strap buckle 228 combination, or adjustable restraint 112, are adjusted to rest in front of ski boot 300 where it will not interfere with ski boot 300 rotating in toe coupling 100.

FIG. 6 is a side view of ladder strap buckle 228 side of one embodiment in climbing mode. Ski boot 300 is shown engaged with toe coupling 100 and telemark tension assembly 110 in ascent mode. Climbing wire 122 is also in ascent mode. Ladder strap buckle 228 and ladder strap 220 are shown resting inactive, loose on toe coupling 100. Ladder strap buckle 228 is closed while ladder strap 220 has been loosened to allow ladder strap buckle 228, ladder strap 220 and wire rope loop 218 to extend around the front of ski boot 300. In this configuration the skier can freely lift the heel of ski boot 300 with no resistance from telemark tension assembly 110. This facilitates walking or striding for touring or climbing.

Figure 7:
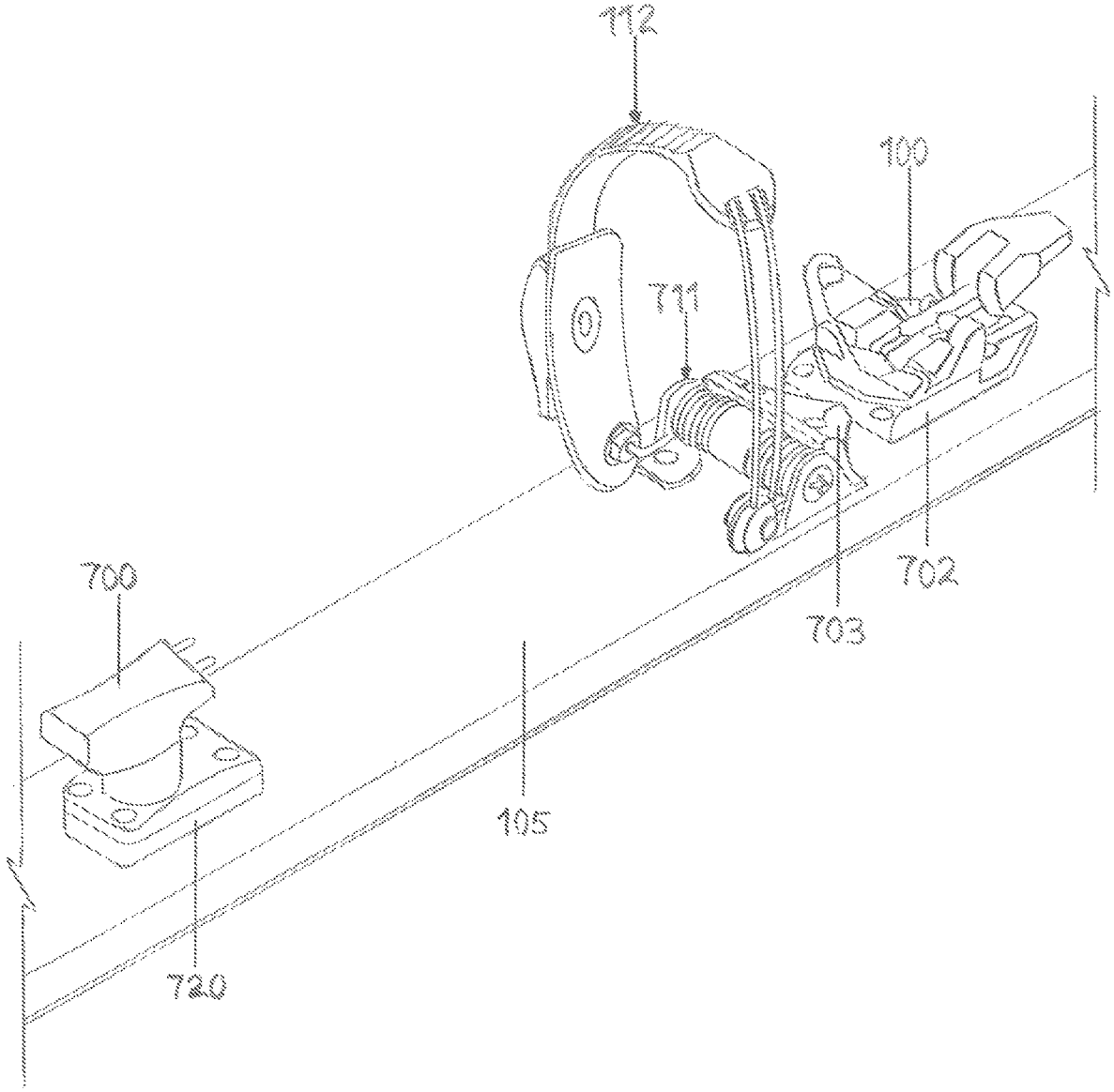
FIG. 7 is a perspective view of an additional embodiment that can be adjusted when mounted to accommodate a range of boot sizes and has alpine descent mode.
Figure 8:
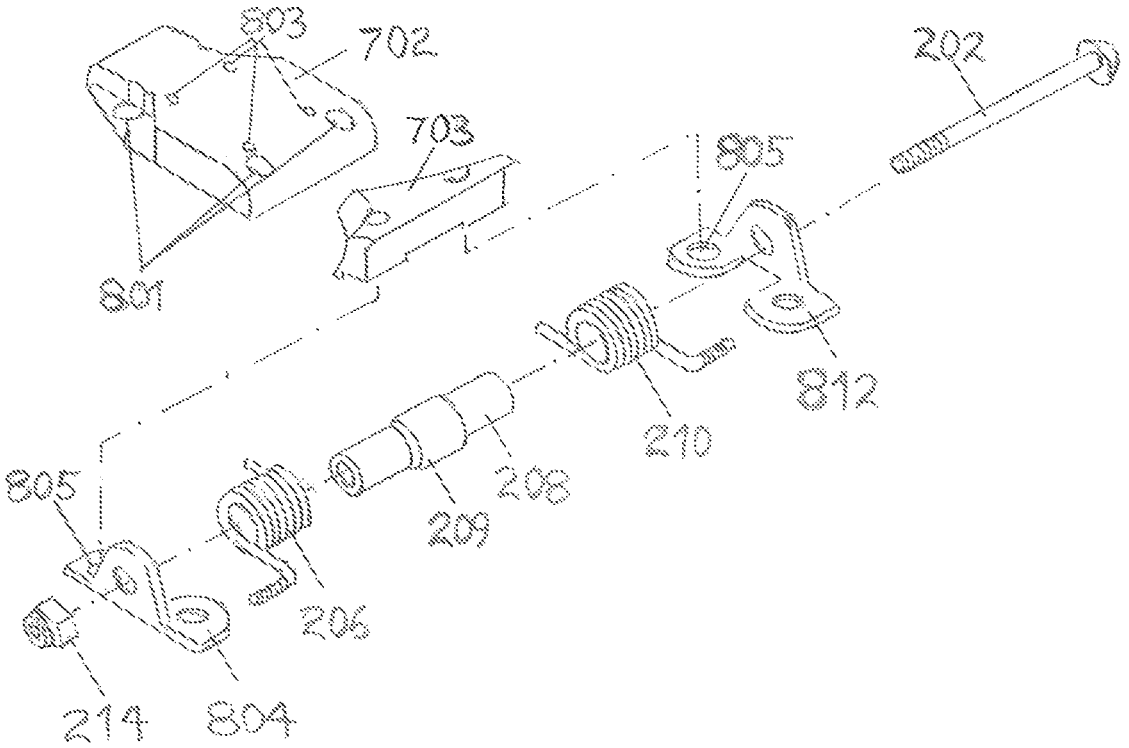
FIG. 8 is an exploded perspective view of a modified rotational tensioner shown first in FIG. 7

Additional Embodiments FIGS. 7-8

FIGS. 7 and 8 show additional embodiments of the binding system. FIG. 7 is a perspective view of an embodiment that can be adjusted when mounted to accommodate a range of boot sizes. The perspective view in FIG. 7 also shows the binding system combined with a conventional tech style alpine touring heel coupling 700. Heel coupling 700 is mounted to ski 105 through a riser or a heel shim 720 for adjusting the height of heel coupling 700 to engage the ski boot heel in the same manner as a conventional alpine touring tech type heel coupling. The ski boot heel pin receptors are also of the conventional tech type (not shown). This allows this embodiment to be used for alpine style turns during descent if desired. Heel coupling 700 can be left in ascent or climbing mode during descent so that telemark style turns can be executed. Alternately, heel coupling 700 can be placed in descent mode for descent if it is desired to execute alpine style turns. Operation of heel coupling 700 is not further discussed since it is well known. This adjustable embodiment includes a modified rotational tensioner or adjustable tensioner 711 that allows adjusting the relative position of toe coupling 100 and adjustable tensioner 711 to accommodate boots of differing lengths. This embodiment includes a riser or toe shim 702 for height adjustment of toe coupling 100 that is separate from the spring mount hardware. Toe coupling 100 is mounted to toe shim 702 which is mounted to ski 105. Toe coupling 100 is of the conventional tech type. Adjustable tensioner 711 is mounted to ski 105 behind toe shim 702. A boot support or boot shim 703 is provided to add support to the flexible sole of telemark ski boots. The shape of boot shim 703 is such that it aids in shedding snow in sticky snow conditions to help prevent snow packing problems. Specifically, I have found that the top surface of boot shim 703 should be rounded with sides that slope away from the center of ski 105 for the best snow shedding characteristics. Boot shim 703 should also have a gloss finish to help prevent snow from sticking. A recess is provided on the bottom of boot shim 703 for the inside legs of outside spring 206 and inside spring 210. The operation and design of adjustable restraint 112 is the same as the first embodiment.

FIG. 8 is an exploded view of adjustable tensioner 711. Toe shim 702 has four outside mount holes or shim mount holes 801 for mounting toe shim 702 to ski 105 and four inside mount holes or toe coupling mount holes 803 for mounting toe coupling 100 to toe shim 702. A modified outside mount bracket 804 and a modified inside mount bracket 812 each have an additional mount hole or bracket mount hole 805 for additional mount strength. Boot shim 703 is mounted to ski 105 through bracket mount holes 805. Outside mount bracket 804 and inside mount bracket 812 can be mounted independently to accommodate boots of differing widths. The lengths of mandrel bolt 202, mandrel 208, and spring spacer 209 can be adjusted to match with the mounting position of outside mount bracket 804 and inside mount bracket 812. Boot shim 703 can be made in various sizes to accommodate different mounting positions of outside mount bracket 804 and inside mount bracket 812. Adjustable restraint 112 is not shown since the operation and design of adjustable restrain 112 is the same as the first embodiment.

Alternative Embodiments

While the toe coupling shown is an alpine touring tech toe, there are other conventional toe couplings that would cooperate with the independent telemark tension assembly, for example a traditional three pin 75 mm cross country toe coupling. Like the tech toe, some have releasability features to enhance safety. Since these are already well known the details of their operation is not discussed. Likewise, there are many types of heel elevator assemblies that are well known and would cooperate with the independent telemark tension assembly. The adjustable restraint could be made with many types of strap and buckle combinations. The ladder strap with a buckle closure is just one of many possible adjustable retaining systems.

There are other ways to make the binding system accommodate different boot sizes as well. One embodiment was presented that would allow adjustment for boot size when the binding system is mounted to a ski but there are other possibilities. For example, mounting slots could be used on the mounting brackets and other spring mount parts in place of holes. Alternately, mounting hardware could be fitted with multiple sets of mounting holes for various mounting positions.

There are many variations possible with regards to mounting the mandrel and mandrel bolt including but not limited to integrating the boot shim with the mandrel bolt brackets and the toe piece shim. Another variation would be to replace the boot shim with a removable crampon for climbing on firm or icy snow pack surfaces.

Advantages

The description above makes evident some advantages of some embodiments of this ski binding system in addition to those stated above:

(a) Simplicity
(b) Cost
(c) Adjustability
(d) Boot compatibility

CONCLUSION, RAMIFICATIONS, AND SCOPE

The Ski Binding with Heelless Telemark coupling provides an embodiment of a lightweight, simple binding system that reduces the problems caused by undesirable snow collection under the boot and in the bindings' mechanisms. Additionally, the binding system embodiment is easy to use with only a single buckle on top of the boot toe box to change from ascent to descent mode. The telemark tensioner can be easily adjusted with the ladder strap and buckle assembly on the fly for skier preference and conditions. The telemark tensioners' simplicity will make it cost competitive to produce. The lack of a rear or heel coupling makes this embodiment compatible with some ski boots that have ski and walk mode mechanisms on the rear of the boot where a rear coupling can interfere.

While a detailed and specific description of one embodiment has been presented, there are many possible variations and alternatives for component design, shape and materials. For example, the boot and toe piece shims could be made of many kinds of plastic or aluminum in many different shapes. The buckle system could be replaced by another style of buckle system and the wire rope loop could be replaced with webbing that would conform to the shape of the boot bellows. Also contemplated is a method for blocking the torsion spring leg movement to provide an alternate alpine descent mode. These potential variations in size, shape, materials, form, assembly, and use can be made without altering the concept set forth in this specification.

I claim:

1. A ski binding system, comprising:

a. a toe coupling that retains a ski boot to a ski near the toe of said ski boot and also allows rotational motion of said ski boot in a plane perpendicular to the base of said ski for climbing or touring purposes, and b. a telemark tension assembly that is fixed to the surface of the ski having an adjustable restraint that is flexible and can conform to the shape of said ski boot, that can be disengaged from said ski boot such that said toe coupling still retains said ski boot, and that extends over the toe box portion of said ski boot on or near the ski boot bellows connected to a rotational tensioner to apply resistance to the rotational motion of said ski boot through said adjustable restraint around the toe box portion of said ski boot substantially above the metatarsal joints of the skier where said rotational tensioner contains a device selected from the group consisting of springs and elastic materials, whereby said ski boot is allowed rotational movement with resistance needed for descending in the telemark style when said adjustable restraint is tightened and said ski boot is allowed free rotational movement for ascent when said adjustable restraint is loosened or disengaged.

2. The ski binding system of claim 1, wherein said rotational tensioner comprises one or more torsion springs.

3. The ski binding system of claim 1, further comprising a boot shim to support the front portion of the ski boot sole substantially under the metatarsal joints of the skier while climbing or touring.

4. The ski binding system of claim 3, wherein said boot shim is shaped in a way that reduces snow packing under the ski boot.

5. The ski binding system of claim 1, further comprising a toe shim to adjust the height of said ski boot when engaged in said toe coupling such that said ski boot rests at the desired position over said telemark tension assembly.

6. The ski binding system of claim 1, further comprising an elevator block to adjust the height of the ski boot heel when engaged in said toe coupling such that the ski boot heel rests at the desired position over said telemark tension assembly.

7. The ski binding system of claim 6, further comprising a climbing wire to adjust the height of the ski boot heel when ascending a slope of substantial angle.

8. The ski binding system of claim 1, further comprising a conventional tech heel coupling that can be engaged to prevent rotational movement of the ski boot heel and facilitate alpine style turns on descent.

9. The ski binding system of claim 1, wherein said adjustable restraint comprises a ladder strap and a ladder strap buckle.

10. A ski binding system, comprising:

a. a toe coupling that retains a ski boot to a ski near the toe of said ski boot and also allows rotational motion of said ski boot in a plane perpendicular to the base of said ski for climbing or touring purposes, b. an adjustable restraint that is flexible and can conform to the shape of said ski boot, that can be disengaged from said ski boot such that said toe coupling still retains said ski boot, and that extends over the toe box portion of said ski boot on or near the ski boot bellows, and c. a means to provide a predetermined amount of tension to the rotational motion of said ski boot through said adjustable restraint around the toe box portion of said ski boot substantially above the metatarsal joints of the skier, whereby said ski boot is allowed rotational movement with the resistance needed for descending in the telemark style when said adjustable restraint is tightened and said ski boot is allowed free rotational movement for ascent when said adjustable restraint is loosened or disengaged.

11. The ski binding system of claim 10, wherein the tension to the rotational motion of said ski boot through said adjustable restraint is provided by one or more torsion springs.

12. The ski binding system of claim 10, further comprising a boot shim to support the front portion of said ski boot sole substantially under the metatarsal joints of the skier while climbing or touring.

13. The ski binding system of claim 12, wherein said boot shim is shaped in a way that reduces snow packing under said ski boot.

14. The ski binding system of claim 10, further comprising a conventional tech heel coupling that can be engaged to prevent rotational movement of the ski boot heel and facilitate alpine style turns on descent.

15. The ski binding system of claim 10, wherein said adjustable restraint comprises a ladder strap and a ladder strap buckle.

16. A method for providing the necessary rotational resistance to a ski boot engaged in a touring toe coupling to the toe box portion of said ski boot substantially above the metatarsal joints of the skier to perform a telemark style turn comprising:

a. providing an adjustable restraint that is flexible and can conform to the shape of said ski boot, that can be disengaged from said ski boot such that said toe coupling still retains said ski boot, and that extends over the toe box portion of said ski boot on or near the ski boot bellows, and b. connecting said adjustable restraint to a rotational tensioner to provide resistance to the rotational motion of said ski boot through said adjustable restraint where said rotational tensioner contains a device selected from the group consisting of springs and elastic materials, whereby said ski boot is allowed rotational movement with resistance needed for descending in the telemark style when said adjustable restraint is tightened and said ski boot is allowed free rotational movement for ascent when said adjustable restraint is loosened or disengaged.

17. The method of claim 16 wherein the tension to the rotational motion of said ski boot through said adjustable restraint is provided by one or more torsion springs.

18. The method of claim 16 further providing a boot shim to support the front portion of the ski boot sole substantially under the metatarsal joints of the skier while climbing or touring wherein said boot shim is shaped in a way that reduces snow packing under the ski boot.

19. The method of claim 16 wherein said adjustable restraint comprises a ladder strap and a ladder strap buckle.

* * * * *